US007108545B2

(12) United States Patent
Ting

(10) Patent No.: US 7,108,545 B2
(45) Date of Patent: Sep. 19, 2006

(54) STACKED ELECTRICAL CARD CONNECTOR ASSEMBLY

(75) Inventor: Chien Jen Ting, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/169,395

(22) Filed: Jun. 28, 2005

(65) Prior Publication Data

US 2006/0141857 A1 Jun. 29, 2006

(30) Foreign Application Priority Data

Dec. 24, 2004 (TW) ..... 93220818 U

(51) Int. Cl.
*H01R 12/20* (2006.01)

(52) U.S. Cl. ..... 439/541.5; 439/607

(58) Field of Classification Search ..... 439/60, 439/64, 79, 541.5, 607
See application file for complete search history.

(56) References Cited

U.S. PATENT DOCUMENTS 6,179,652 B1 * 1/2001 Tung et al. ..... 439/541.5
6,238,240 B1 * 5/2001 Yu ..... 439/541.5
6,287,129 B1 * 9/2001 Kuo ..... 439/79
2005/0277333 A1 * 12/2005 Kuo ..... 439/607

FOREIGN PATENT DOCUMENTS

CN 2662470 Y 12/2004

* cited by examiner

*Primary Examiner*—Tho D. Ta
*Assistant Examiner*—James R. Harvey
(74) *Attorney, Agent, or Firm*—Wei Te Chung

(57) ABSTRACT

A stacked electrical card connector assembly comprises an upper electrical connector (1) having a row of first tail portions (121), a lower electrical connector (2) stacked with the upper electrical connector (1) and having a row of second tail portions (221) having bigger width than the row of the first tail portions (121), a locator (51) assembled to a bottom surface of a rear end of the lower electrical connector (2) and receiving the first and second tail portions (121, 221), and a socket (52) adapted to be mounted on a printed circuit board and provided with a first and second terminals (521, 522) for electrically connecting with corresponding the first and second tail portions (121, 221) when the locator (51) is inserted into the socket (52).

14 Claims, 5 Drawing Sheets

STACKED ELECTRICAL CARD CONNECTOR ASSEMBLY

BACKGROUND OF THE INVENTION

1. Field of the Invention

The present invention generally relates to an electrical card connector assembly, more particularly to an improved electrical card connector assembly for connecting two different electronic cards to a printed circuit board (PCB).

2. Description of Related Art

With the tendency of reducing the size of a computer device, demand has arisen for increasing its data storage capacity at low cost. Generally, electrical cards, such as memory cards, are data storage devices which are electrically connected to the computer device. The electrical cards are portable instruments that are readily inserted into and extracted from electrical connectors of the computer device. The connectors typically have sockets to receive the electrical cards therein and headers connected to the computer device such that data can be transferred therebetween.

Due to the ever-increasing demand in today's Notebook Personal Computer (Notebook-PC) for high-capacity signal transmission, more electrical card connectors of the same kind or different kinds are arranged in "dual port" or stacked configurations. As disclosed in China Pat. issue No. 2662470Y, an electrical card connector comprises an insulative housing defining a recess in an insulative header thereof and a transition device retained in the recess. The insulative housing further defines a first receiving room and a second receiving room for receiving two different electronic cards. The transition device has a plug protruding downwardly from a bottom surface thereof, and the plug provides a plurality of first terminals and a plurality of second terminals extending downwardly at opposite longitudinal sides thereof. The electrical card connector further has a plurality of first and second electrical contacts with free ends extending into the first and second receiving room for engaging with the electronic cards and opposite ends soldered on the transition device and connecting with the first and second terminals of the plug. As a result, when the two different electronic cards are inserted into the first and second receiving rooms, the electronic cards are connected to the first and second terminals of the plug. Furthermore, when the plug is inserted to a socket soldered on a printed circuit board (PCB), the electronic cards are finally connected to the PCB.

However, the signal transmission from the electronic cards to the PCB by the electrical card connector is complex and not good for the signal is through three retransmitting. Moreover, the configuration of the transition device is complex thereby increasing the manufacturing cost.

Therefore, the present invention is directed to solving the above problems by providing an improved stacked electrical card connector assembly which can improve the quality of the transmission and further reduces the cost.

SUMMARY OF THE INVENTION

Accordingly, an objection of the present invention is to provide a stacked electrical card connector assembly which can be used for receiving two different electronic cards therein.

Another object of the present invention is to provide a stacked electrical card connector assembly with an improved transition device which improves the quality of the transmission and further reduces the manufacturing cost.

In order to achieve the objection set forth, a stacked electrical card connector assembly in accordance with the present invention comprises an upper electrical connector defining a first receiving room for receiving a card and having a plurality of first electrical contacts with a row of first tail portions bending downwardly at terminals thereof, a lower electrical connector stacked with the upper electrical connector, which defines a second receiving room for receiving a different card and has a plurality of second electrical contacts with a row of second tail portions bending downwardly at terminals thereof having bigger width than the row of the first tail portions, a locator assembled to a bottom surface of a rear end of the lower electrical connector and receiving the first and second tail portions, and a socket adapted to be mounted on a printed circuit board and provided with a first and second terminals for electrically connecting with corresponding tail portions of the first and second electrical contacts when the locator is inserted into the socket.

Other objects, advantages and novel features of the present invention will become more apparent from the following detailed description of the present embodiment when taken in conjunction with the accompanying drawings.

DETAILED DESCRIPTION OF THE INVENTION

Figure 1:
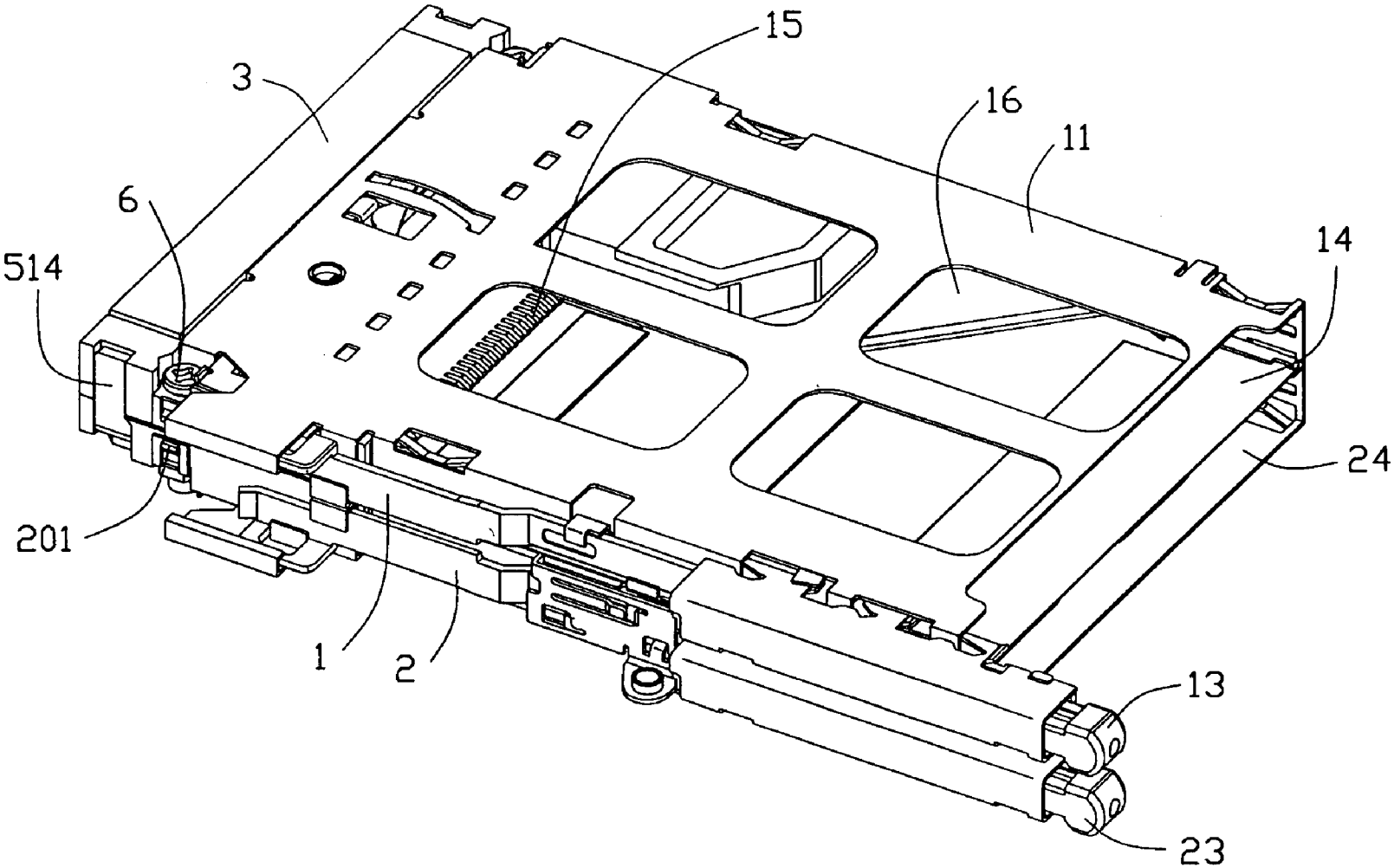
FIG. 1 is a perspective assembled view of a stacked electrical card connector assembly in accordance with the present invention.

Reference will now be made to the drawing figures to describe the present invention in detail.

Figure 3:
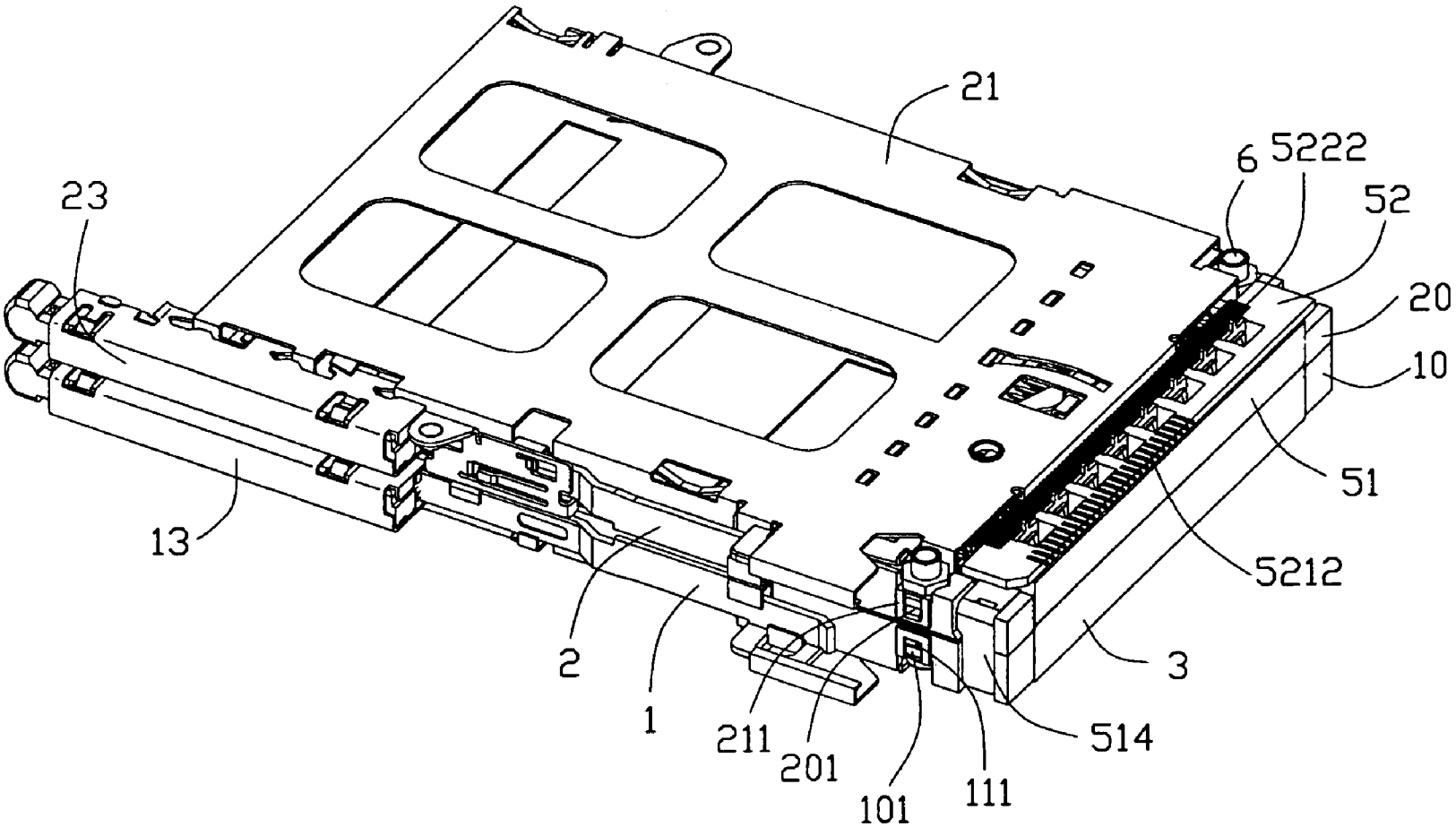
FIG. 3 is an inverse perspective assembled view of the stacked electrical card connector assembly.
Figure 5:
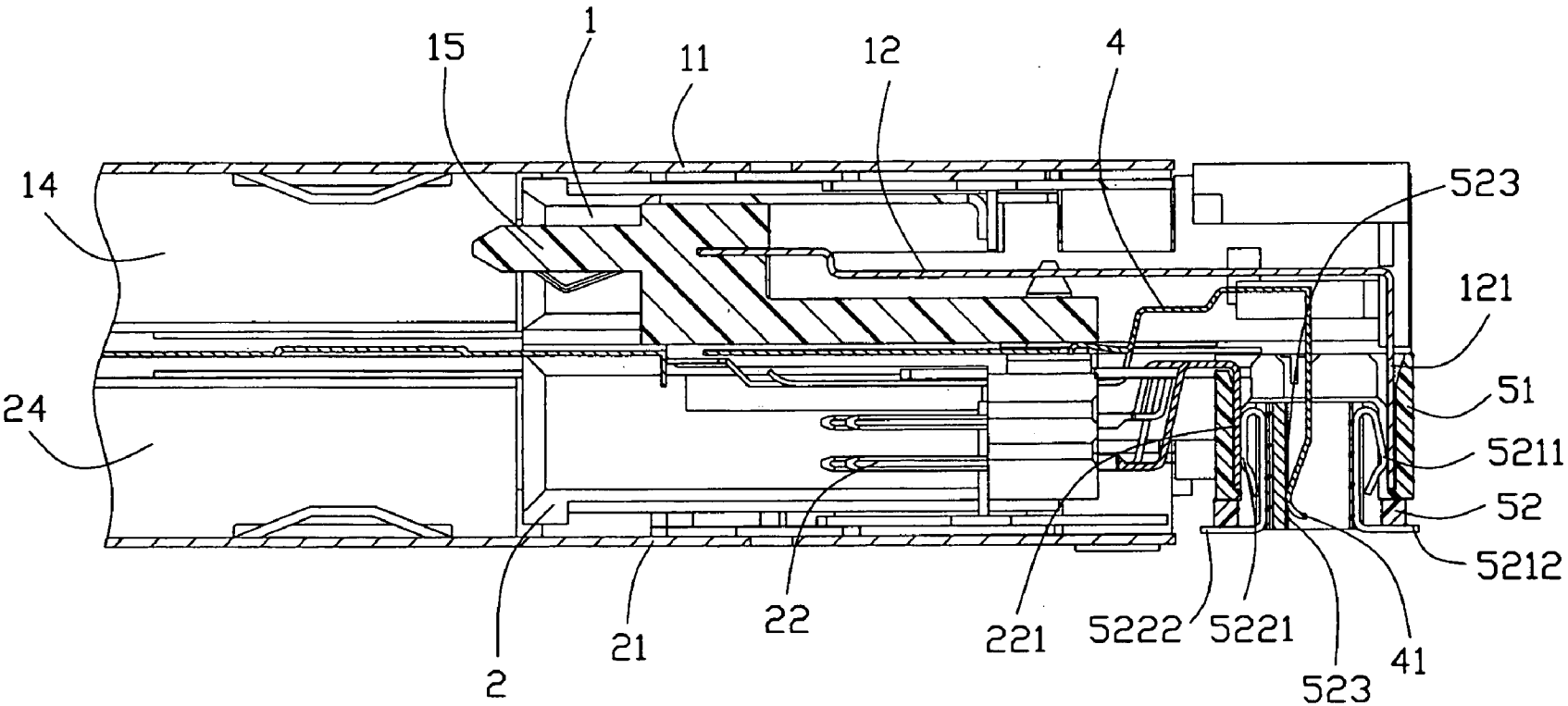
FIG. 5 is a cross-sectional view of the stacked electrical card connector assembly showing the socket received in the locator.

Referring to FIGS. 3 and 5, a stacked electrical card connector assembly in accordance with the present invention comprises an upper electrical connector 1, a lower electrical connector 2 stacked with the upper electrical connector 1 by a bolt 6 securing them together, a grounding plate 4 provided between the upper electrical connector 1 and the lower electrical connector 2, and a locator 51 assembled to a bottom surface of a rear end of the lower electrical connector 2, and a socket 52 received in the locator and mounted on a printed circuit board (PCB) (not shown). The upper electrical connector 1, the lower electrical connector 2 and the grounding plate 4 are all together connected to the PCB through the locator 51 and the socket 52.

Figure 2:
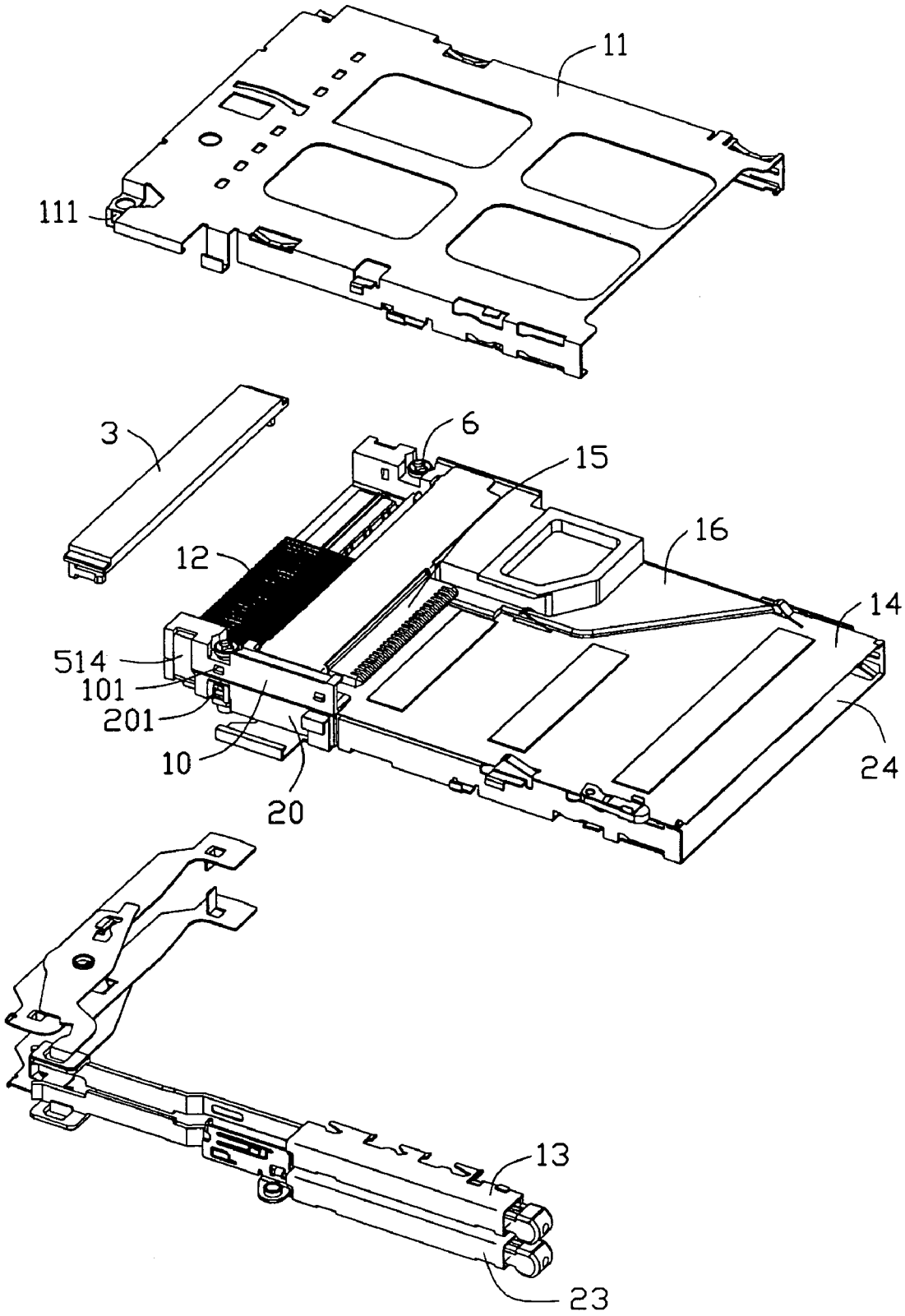
FIG. 2 is a perspective exploded view of the stacked electrical card connector assembly.

Referring to FIGS. 1 and 2, the upper electrical connector 1 is adapted to receive a small card such as an Express Card. At the present embodiment, the upper electrical connector 1 receiving an Express Card (not shown) comprises an upper header 10, an upper shielding 11 covering on a front half of the upper header 10, a first receiving room 14 defined by the upper shielding 11 combining with the front half of the upper header 10, and a first card release mechanism 13 assembled to a longitudinal side of the upper header 10. The upper electrical connector 1 further has a tongue 15 projecting from a part of the upper header 10 close to the first card release mechanism 13 to the first receiving room 14 and a slant prominency 16 projecting from the other part of the upper header 10 to the first receiving room 14. The slant prominency 16 makes the first receiving room 14 as L-shaped for receiving the Express Card of L-shaped, that is a gap of the Express Card matches the slant prominency 16 and a shorter side of the Express Card electrically engages with a plurality of first electrical contacts 12 enchased in the tongue 15. Otherwise, the upper shielding 11 has a locking hole 111 for receiving a latch 101 provided on the upper header 10 therein thereby being secured on the upper header 10.

Figure 4:
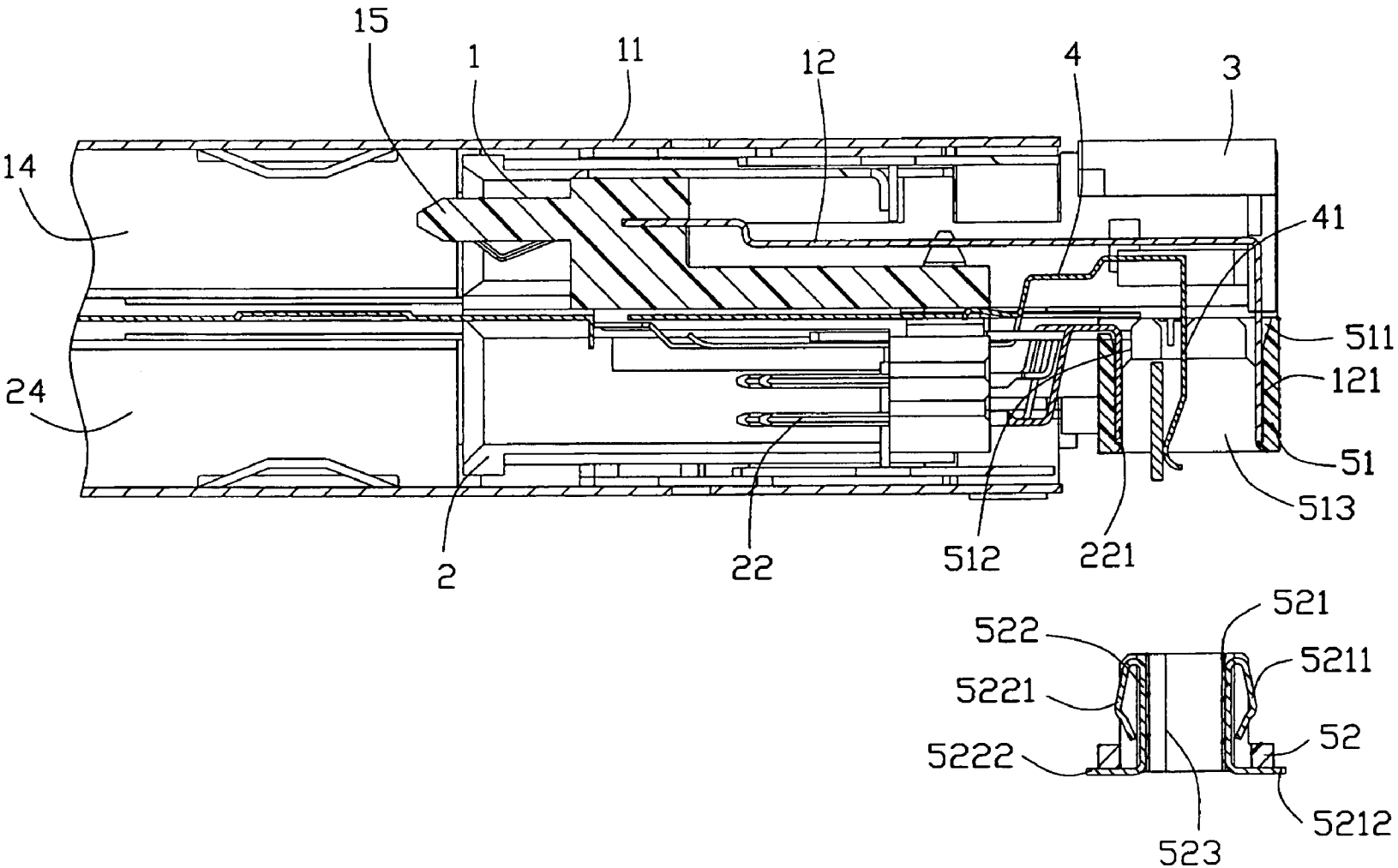
FIG. 4 is a cross-sectional view of the stacked electrical card connector assembly, showing a socket of the connector assembly separate from a locator received in the connector assembly.

Further referring to FIGS. 2–4, The lower electrical connector 2 under the upper electrical connector 1 is adapted to receive a card such as a Card Bus. At the present embodiment, the lower electrical connector 2 receiving a Card Bus (not shown) comprises a lower header 20 under the upper header 10, a lower shielding 21 covering on a bottom surface of a front half of the lower header 20, a second receiving room 24, a plurality of second electrical contacts 22 retained in the lower header 20, and a second card release mechanism 23 assembled to a longitudinal side of the lower header 20. The second receiving room 24 is defined by the lower shielding 21 combining with the front half of the lower header 20 and for receiving the Card Bus. The lower shielding 21 has a locking hole 211 for receiving a latch 201 provided on the lower header 20 therein thereby being secured on the lower header 20. Otherwise, the second card release mechanism 23 is disposed at the same side with the first card release mechanism 13 for facilitating extracting cards.

The first electrical contacts 12 and the second electrical contacts 22 are different in their numbers and arrangement in the upper and lower electrical connectors 1, 2. The first electrical contacts 12 are arranging in one row, while the second electrical contacts 22 are arranging in two rows. The first electrical contact 12 has two ends with one end protruding to the first receiving room 14 for engaging with the Express Card and the other end extending reversely and bending downwardly at a terminal of the other end to form a first tail portion 121. At the other hand, one end of the second electrical contact 22 protrudes to the second receiving room 24 and has an acicular terminal for connected with a receiving hole of the Card Bus, and the other end extends reversely and bends downwardly at a terminal of the other end to form a second tail portion 221. The width of the row of first tail portion 121 is smaller than that of the row of the second electrical contacts 221 for the upper electrical connector 1 has the slant prominency 16 adjacent to the tongue 15.

The stacked electrical card connector assembly further comprises a spacer 3 covered on the first electrical contacts 12, which are on a rear half of the upper header 10 and exposed out of the upper shielding 11, so as to limit the first electrical contacts 12 of the upper electrical connector 1.

The locator 51 is assembled to a bottom surface of a rear half of the lower header 20 exposed out of the lower shielding 21 of the lower electrical connector 2. The locator defines a row of first passageways 511, a row of middle passageways 513 and a row of second passageways 512 sequenced from an outer longitudinal side far from the stacked electrical card connector assembly to an inner longitudinal side near to the stacked electrical card connector assembly. The row of first passageways 511, the row of middle passageways 513 and the row of second passageways 512 are all arranging along the longitudinal side of the locator 51 and respectively retaining the first tail portions 121 of the first electrical contacts 12, a plurality of grounding tails 41 extending downwardly from an end of the grounding plate 4 and the second tail portions 221 of the second electrical contacts 22. In addition, the locator 51 provides a pair of mounting sections 514 extending upwardly from two opposite ends of the longitudinal side thereof so as to further stack the lower electrical connector 2 with the upper electrical connector 1.

The socket 52 provides a row of first terminals 521, a row of middle terminals 523 and a row of second terminals 522 arranged in sequence. Each of the first terminal 521 forms a first engaging section 5211 bending reversely and a first soldering section 5212, in the same way, each of the second terminal 522 forms a second engaging section 5221 bending reversely and a second soldering section 5222, and each of the middle terminal 523 forms a middle engaging section (not labeled) and a middle soldering section (not labeled).

In assembly, the socket 52 is assembled in the locator 51 with the first engaging sections 5211 of the first terminals 521 retaining in the first passageways 511 and being pressed upon the first tail portions 121 of the first electrical contacts 12, the second engaging sections 5221 of the second terminals 522 retaining in the second passageways 512 and being pressed upon the second tail portions 221 of the second electrical contacts 22, and the middle engaging sections of the middle terminals 523 retaining in the middle passageways 513 and being pressed upon the grounding tails 41 of the grounding plate 4. For the engaging sections 5211, 5221 are pressed upon the tail portions 121, 221 when the socket 52 is assemble to the locator 51, the connection between the engaging sections 5211, 5221 and the tail portions 121, 221 is much better. The engaging sections 5211, 5221 provide the first and second terminals 521, 522 with resiliency so that the locator 51 contacts the socket 52 with a low insertion force. Simultaneously, the first soldering sections 5212, the second soldering sections 5222 and the middle soldering sections of the socket 52 are soldered on the PCB, as a result, the stacked electrical card connector assembly is connected to the PCB through the transition device 5.

It should be noted that the signal transmission from the two different electronic cards to the PCB by the stacked electrical card connector assembly is better for the signal is only through two retransmitting. Moreover, the configuration of the locator is much simpler thereby reducing the manufacturing cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector assembly for receiving two different electronic cards comprising:

an upper electrical connector defining a first receiving room for receiving a card and having a plurality of first electrical contacts with a row of first tail portions bending downwardly at terminals thereof;

a lower electrical connector stacked with the upper electrical connector, which defines a second receiving room for receiving a different card and has a plurality of second electrical contacts with a row of second tail portions bending downwardly at terminals thereof, the row of first tail portions having smaller width than the row of the second tail portions;

a locator assembled to a bottom surface of a rear end of the lower electrical connector and receiving the first and second tail portions; and a socket adapted to be mounted on a printed circuit board and provided with a first and second row of terminals for electrically connecting with corresponding tail portions of the first and second electrical contacts when the locator is inserted thereinto;

wherein the upper electrical connector further has a prominent slant adjacent to the first electrical contacts and the prominent slant has the same width with a gap between the width of the row of first and second tail portions, while the second electrical contacts of the lower electrical connector have acicular terminals for connected with receiving holes on a card therein.

2. The stacked electrical card connector assembly as described in claim 1, wherein the upper electrical connector is for receiving an Express Card.

3. The stacked electrical card connector assembly as described in claim 1, wherein the locator defines a row of first passageways and a row of second passageways respectively retaining the first tail portions and the second tail portions.

4. The stacked electrical card connector assembly as described in claim 3, wherein the first terminal of the socket forms a first engaging section bending reversely and the second terminal of the socket also forms a second engaging section bending reversely.

5. The stacked electrical card connector assembly as described in claim 1, further comprising a grounding plate disposed between the upper electrical connector and the lower electrical connector and the grounding plate has a plurality of grounding tails extending downwardly portions and the second tail portions, and disposed between the first tail.

6. The stacked electrical card connector assembly as described in claim 5, wherein the locator further comprises a row of middle passageways for receiving the grounding tails and the socket further comprises a row of middle terminals engaging with the grounding tails.

7. The stacked electrical card connector assembly as described in claim 1, wherein the locator further provides a pair of mounting sections extending upwardly from two opposite ends of a longitudinal side thereof.

8. The stacked electrical card connector assembly as described in claim 1, further comprising a spacer disposed on rear ends of the first electrical contacts of the upper electrical connector.

9. An electrical connector assembly comprising:

first and second connectors stacked with each other;

the first connector defining a first card receiving room and a plurality of first contacts in communication with the first card receiving room with a rear portion of the first connector having a plurality of first downwardly extending tail portions arranged in a first row having a first pitch and a first number thereof;

the second connector defining a second card receiving room and a plurality of second contacts in communication with the second card receiving room with a rear portion of the second connector having a plurality of second downwardly extending tail portions arranged in a second row and having a second pitch and a second number thereof which are different from the first pitch and the first number;

a socket including an insulative housing defining opposite first and second side walls; wherein a plurality of first terminals with the same first pitch and first number are disposed on the first side wall and engaged with the corresponding first contacts, respectively, and a plurality of second terminals with the same second pitch and second number are disposed on the second side wall and engaged with the corresponding second contacts, respectively;

wherein the first electrical connector further has a prominent slant adjacent to the first electrical contacts and the prominent slant has the same width with a gap between the width of the row of first and second tail portions, while the second electrical contacts of the second electrical connector have acicular terminals for connected with receiving holes on a card therein.

10. The assembly as claimed in claim 9, further including a locator associated with the first and second tail portions to couple to the socket.

11. The assembly as claimed in claim 10, wherein a grounding plate is located vertically between the first and the second connectors, and said grounding plate further includes grounding tails vertically extending between the first tail portions and the second tail portions.

12. The assembly as claimed in claim 10, wherein said locator encloses said socket.

13. The assembly as claimed in claim 9, the first connector is located under the second connector, and the first terminals are located on an inner side with regard to the second terminals.

14. The assembly as claimed in claim 9, wherein said first connector includes a first metallic shell structure to define the first card receiving room, and said second connector includes a second metallic shell structure to define the second card receiving room.

* * * * *